US005941263A

United States Patent [19]

Bierman

[11] Patent Number: 5,941,263

[45] Date of Patent: Aug. 24, 1999

[54] LEG SUPPORT CRUTCH

[75] Inventor: Steven F. Bierman, Del Mar, Calif.

[73] Assignee: Venetec International, Inc., San Diego, Calif.

[21] Appl. No.: 08/953,321

[22] Filed: Oct. 17, 1997

[51] Int. Cl.[6] ..... A61H 3/02; A61F 2/60

[52] U.S. Cl. ..... 135/68; 135/66; 135/69; 135/75; 602/26; 623/28

[58] Field of Search ..... 135/65, 66, 67, 135/68, 69, 71, 72, 73, 75; 297/4, 5, 6; 248/125.8, 155, 155.5, 188; 602/23, 26, 28; 623/27, 28, 39, 44

[56] References Cited

U.S. PATENT DOCUMENTS

| | | | |
|---|---|---|---|
| D. 362,506 | 9/1995 | Bieri . | |
| 1,185,906 | 6/1916 | Hoff . | |
| 2,530,544 | 11/1950 | Schwantes | 297/4 |
| 2,678,054 | 5/1954 | Bostelman . | |
| 2,778,370 | 1/1957 | Chamblee . | |
| 3,016,060 | 1/1962 | Beattie, Sr. | 135/68 |
| 3,633,967 | 1/1972 | Timmins . | |
| 3,696,826 | 10/1972 | Gruzalski . | |
| 4,141,375 | 2/1979 | Tykwinski . | |
| 4,254,948 | 3/1981 | Jacobs . | |
| 4,291,715 | 9/1981 | Monte . | |
| 4,388,920 | 6/1983 | Hajost et al. . | |
| 4,451,080 | 5/1984 | Nix | 297/4 |
| 4,700,406 | 10/1987 | Meistrell . | |
| 4,784,128 | 11/1988 | Scheuermann . | |
| 4,793,370 | 12/1988 | Perez et al. . | |
| 4,910,927 | 3/1990 | Beatty . | |
| 4,924,894 | 5/1990 | Martinez . | |
| 5,113,887 | 5/1992 | Herman, Jr . | |
| 5,178,595 | 1/1993 | MacGregor . | |
| 5,291,909 | 3/1994 | Skorman et al. . | |
| 5,300,016 | 4/1994 | Marlatt . | |
| 5,318,068 | 6/1994 | Haugen . | |
| 5,575,299 | 11/1996 | Bieri . | |
| 5,628,335 | 5/1997 | Free | 135/68 |

*Primary Examiner*—Carl D. Friedman
*Assistant Examiner*—Winnie S. Yip
*Attorney, Agent, or Firm*—Knobbe, Martens, Olsen & Bear, LLP

[57] ABSTRACT

A single leg support crutch provides improved stability and balance to a user, who suffers from foot, ankle or lower leg injury, in order to enhance ambulatory movement of the user during recuperation. The leg support crutch comprises a unitary leg cradle that conforms generally to a user's thigh, knee and lower leg, and a plurality of fasteners that comfortably secure the leg support crutch to the user's leg while in a bended position. A support strut is releasably attached to the cradle and is positioned to support the weight of the user when standing or walking. A releasable coupling attaches the strut to the cradle at one of a plurality of locations. The multiple locations of the strut on the cradle allow the position of the strut to be adjusted in order to properly align the axis of the strut with the location of the user's femur in the cradle. As a result, the weight of the user is transferred more efficiently to the strut to improve the user's comfort when standing or walking.

23 Claims, 6 Drawing Sheets

LEG SUPPORT CRUTCH

BACKGROUND OF THE INVENTION

1. Field of the Invention

The present invention relates generally to crutches and more specifically to leg support crutches designed to permit ambulatory movement by a patient recuperating from an injured foot or lower leg.

2. Description of Related Art

A patient after injuring a foot or lower leg, commonly uses a pair of crutches to support himself or herself when recuperating. The crutches aid the patient when walking by supporting a portion of the patient's body weight.

Each crutch conventionally includes a pair of legs attached to an upper cross bar or crutch head. The legs depend downwardly from the crutch head towards a lower end. The crutch also includes a hand grip attached to the legs and positioned between the crutch head and the lower end, about two-thirds up the length of the crutch from the lower end.

The patient uses the crutch by placing the crutch head under his or her arm in the axilla (i.e., armpit) and grasping the hand grip. The patient generally supports his or her weight by the combination of grasping the hand grip and resting on the crutch head. Unfortunately, extended use of conventional crutches generally results in some discomfort to the axillae and lateral sides of the rib cage, and may result in nerve injury.

To overcome the disadvantage of conventional crutches, there have been efforts to develop a single support crutch that more directly supports the user's leg without the need to grip the crutch with one's hands or bear upon the crutch at or about the axillae and rib cage. U.S. Pat. Nos. 5,575,299, 5,300,595 and 5,178,595 disclose examples of such prior single support crutches. In essence, each of these single support crutches removes stress from the user's axillae and rib cage and transfers that stress to the user's knee and thigh. None of the single support crutches to date, however, have been able (i) to satisfactorily minimize the stresses on a user's knee, (ii) to more evenly distribute the forces that bear upon the user's thigh during use, and (iii) to provide the stability required for full ambulatory movement of the user.

SUMMARY OF THE INVENTION

A need therefore exists for a method and a device for minimizing the stress upon the knee and thigh while permitting a patient as full ambulatory movement as possible during recuperation.

One aspect of the present invention thus involves an improved leg support crutch that permits ambulatory movement of a user recuperating from a lower leg or foot injury. The leg support crutch supports the user's upper body and injured lower leg in a manner that transfers the user's body weight through the user's thigh and knee directly to the leg support crutch so as to bypass weight transfer through the user's injured lower leg or foot. The leg support crutch comprises a unitary leg cradle, a support strut connected to the leg cradle, an interengaging structure for releasably connecting the support strut to the leg cradle at a plurality of locations, and a plurality of fasteners to secure the user's leg within the leg cradle.

The leg cradle desirably has a generally L-shaped configuration defined by a first portion contoured to loosely conform to the shape of a user's thigh and a second portion positioned generally normal to the first portion and integral therewith. The second portion is contoured to loosely conform to the shape of a user's lower leg. The junction of the first and second portion forms a curvilinear profile conforming loosely to the user's knee.

The first and second portions include corresponding vertical and longitudinal axes that intersect at a generally right angle. The axis of each portion is defined centrally between the corresponding sides of the portion and is distanced from a front or lower wall of the corresponding first or section portion. For instance, the vertical axis of the first portion desirably is distanced from the front wall by a sufficient distance to generally align the vertical axis with the user's femur when in use.

The first portion is sufficiently long so as to secure the first portion high-up on the user's thigh. This length of the first portion generally inhibits movement of the first portion relative to the user's thigh without unduly binding the thigh and overly constricting the arteries and veins in the leg (e.g., the popliteal artery).

The cradle is further defined by integral gussets. The gussets join together and reinforce the first and second portions so as to transfer forces (e.g., weight) from the second portion to the first portion when the second portion is supporting the user's lower leg. Each gusset extends between the first and second portions and the gussets are positioned to straddle a portion of the user's lower leg and thigh when in use.

The support strut detachably connects to the cradle proximal to the intersection of the first and second portions so as to be generally parallel with the longitudinal axis of the first portion when the support strut is attached to the cradle. The strut is adjustable in length to permit use of the prosthetic device by users of different leg lengths.

The interconnecting structure detachably connects the support strut to the leg cradle at a plurality of locations. The position of the strut thus may be adjusted to position the strut to lie generally collinear with the user's femur to transfer of the user's body weight to the strut. The strut thereby simulates the balance and support normally provided by the user's lower leg and foot.

There are a plurality of adjustable fasteners positioned on each of the first and second portions of the leg cradle to hold the user's thigh and lower leg tightly in the cradle. The fasteners are positioned to maximize the stability of the prosthetic device while in use and to minimize constriction of the user's leg. A first fastener of the plurality is positioned at an upper end of the first portion to maximize the force securing the first portion to the user's thigh (i.e., to maximize the moment arm created by the first portion with respect to an axis of rotation through the user's knee). This force resists the tendency of the strut, when in motion, to pull the first portion away from the user's thigh, thereby inhibiting the cradle from rotating about the user's knee. This arrangement also minimizes the reactive forces experienced by the user's thigh in resisting such rotation.

A second fastener is also arranged on the first portion near a lower end of the first portion but sufficiently spaced therefrom to permit attachment of the cradle to the user's leg above the popliteal fossa. This arrangement minimizes constriction of the popliteal artery caused by this second fastener when in use.

The plurality of fasteners further includes at least two fasteners—a third and a fourth fastener—positioned on the second portion. These fasteners permit attachment of the second portion to the lower leg of the user. The third fastener is desirably positioned proximal to the middle of the user's calf muscle when attached, and the fourth fastener is desirably positioned between the bottom of the user's calf and the user's ankle.

Further aspects, features, and advantages of the present invention will become apparent from the detailed description of the preferred embodiment which follows.

BRIEF DESCRIPTION OF THE DRAWINGS

The above-noted and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
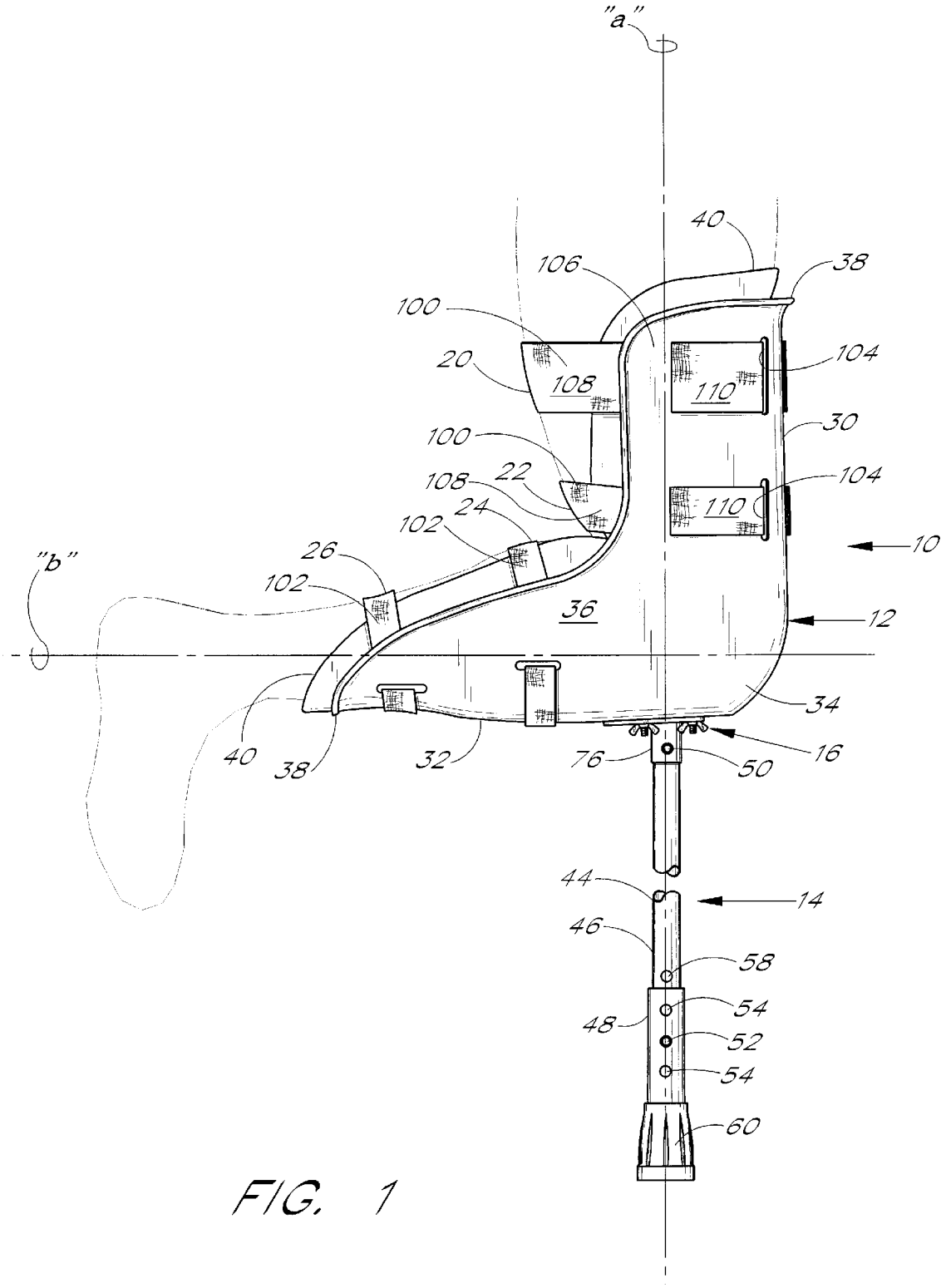
FIG. 1 illustrates a side elevational view of the leg support crutch configured in accordance with a preferred embodiment of the present invention, as applied to a user's thigh and lower leg.
Figure 2:
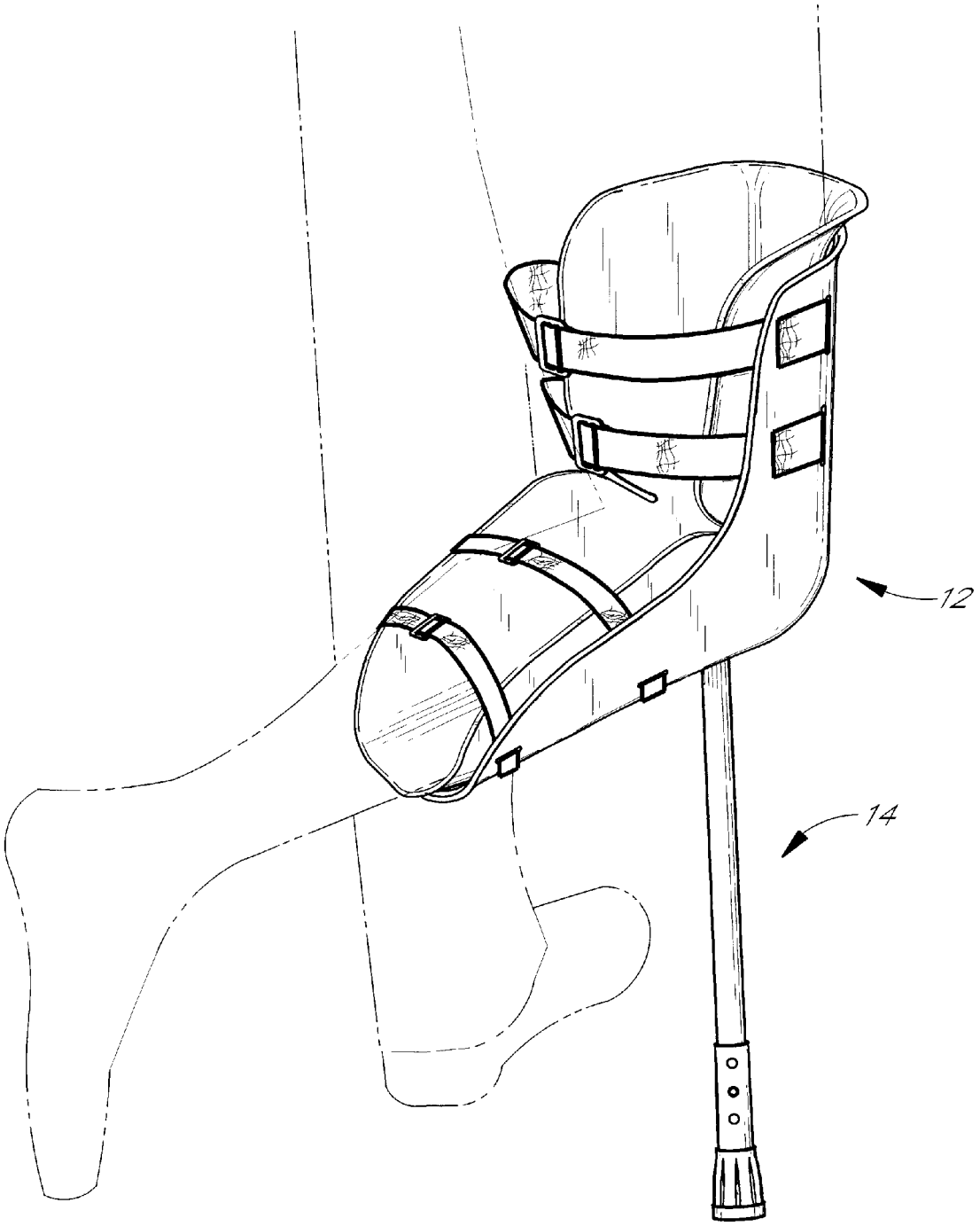
FIG. 2 illustrates a perspective view of the leg support crutch of FIG. 1, from a rear-left side.
Figure 3:
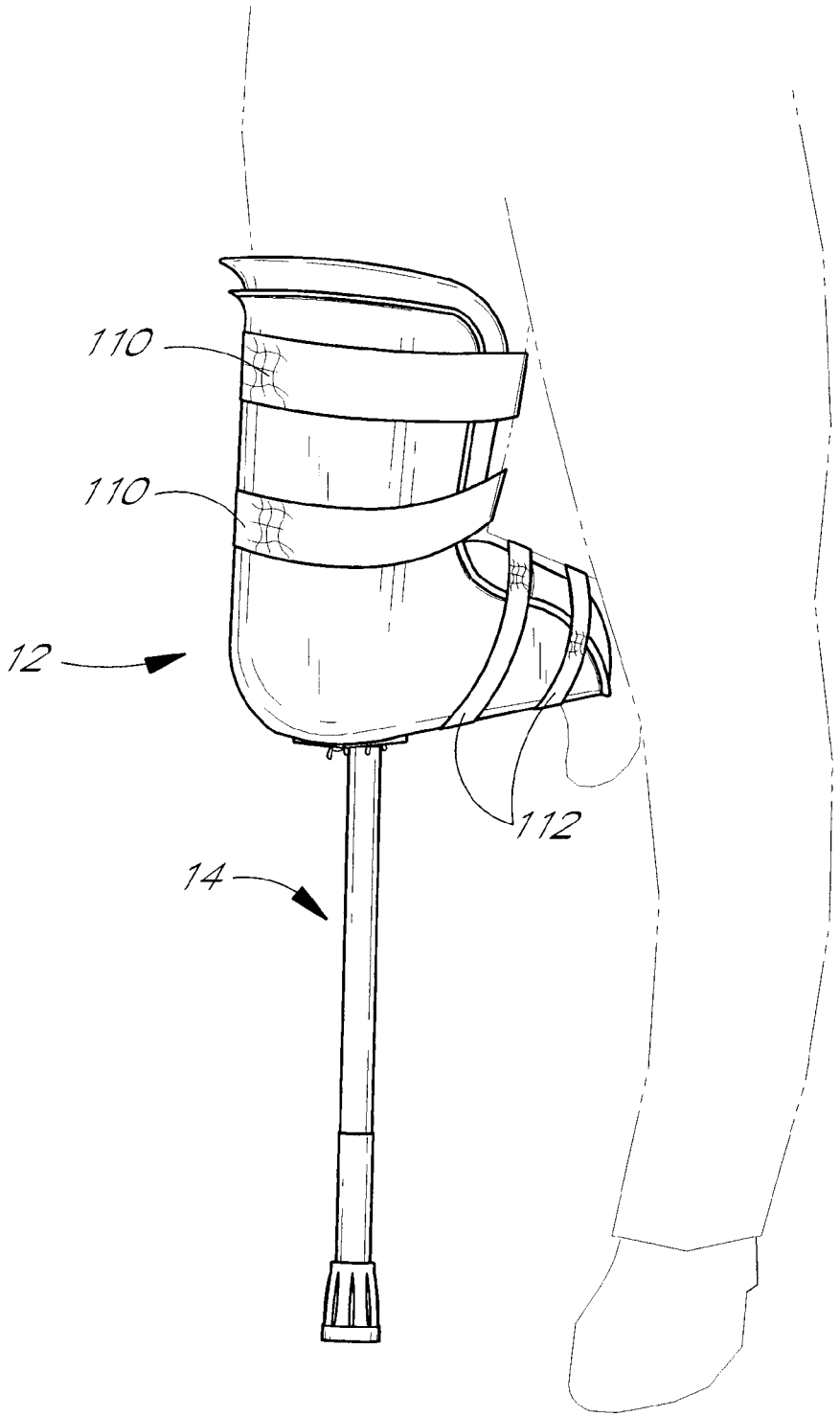
FIG. 3 illustrates a perspective view of the leg support crutch of FIG. 1, from a front-right side.

With reference to FIGS. 1 through 3, a preferred embodiment of the leg support crutch 10 is shown as applied to a user (shown in phantom). The leg support crutch 10 is defined by a leg cradle 12, preferably molded in unitary construction, and a detachable support strut 14. An interengaging structure 16 connects the support strut 14 to the leg cradle 12 in a manner that permits quick detachment and adjustment relative to the cradle, as well as connects the support strut 14 to the cradle 12 in at least two different positions relative to a vertical axis a of the cradle 12, as described below.

The leg cradle 12 supports the thigh, knee and lower leg of a user recuperating from a lower leg or foot injury in a manner that comfortably transfers the weight of the user through the cradle 12 to the support strut 14. This is done in a manner that also simulates the balance and support normally provided by the user's lower leg and foot, thus enhancing recuperation while the user remains ambulatory.

The leg cradle 12 includes a desirably plurality of fasteners—four fasteners 20, 22, 24 and 26 in the illustrated embodiment—to securely attach the user's thigh and lower leg to the leg cradle while in use. Each fastener is strategically positioned along the cradle 12 to firmly hold the user's leg within the cradle 12 without unduly constricting user's leg.

Leg Cradle

As seen in FIGS. 1 through 3, the leg cradle 12 is principally defined by a first portion 30, which bears against the user's thigh, and a second portion 32, which carries the user's lower leg. The first and second portions 30, 32 are contoured to loosely conform to the shape of a user's thigh and lower leg, respectively. Thus, both the first and second portions 30, 32 generally have an arcuate channel that wraps about a anterior portion of the user's leg. The channel generally has a U-shaped cross-sectional shape formed between side walls and an interconnecting wall, i.e. a front wall on the first portion 30 and a bottom wall on the second portion 32.

Figure 5:
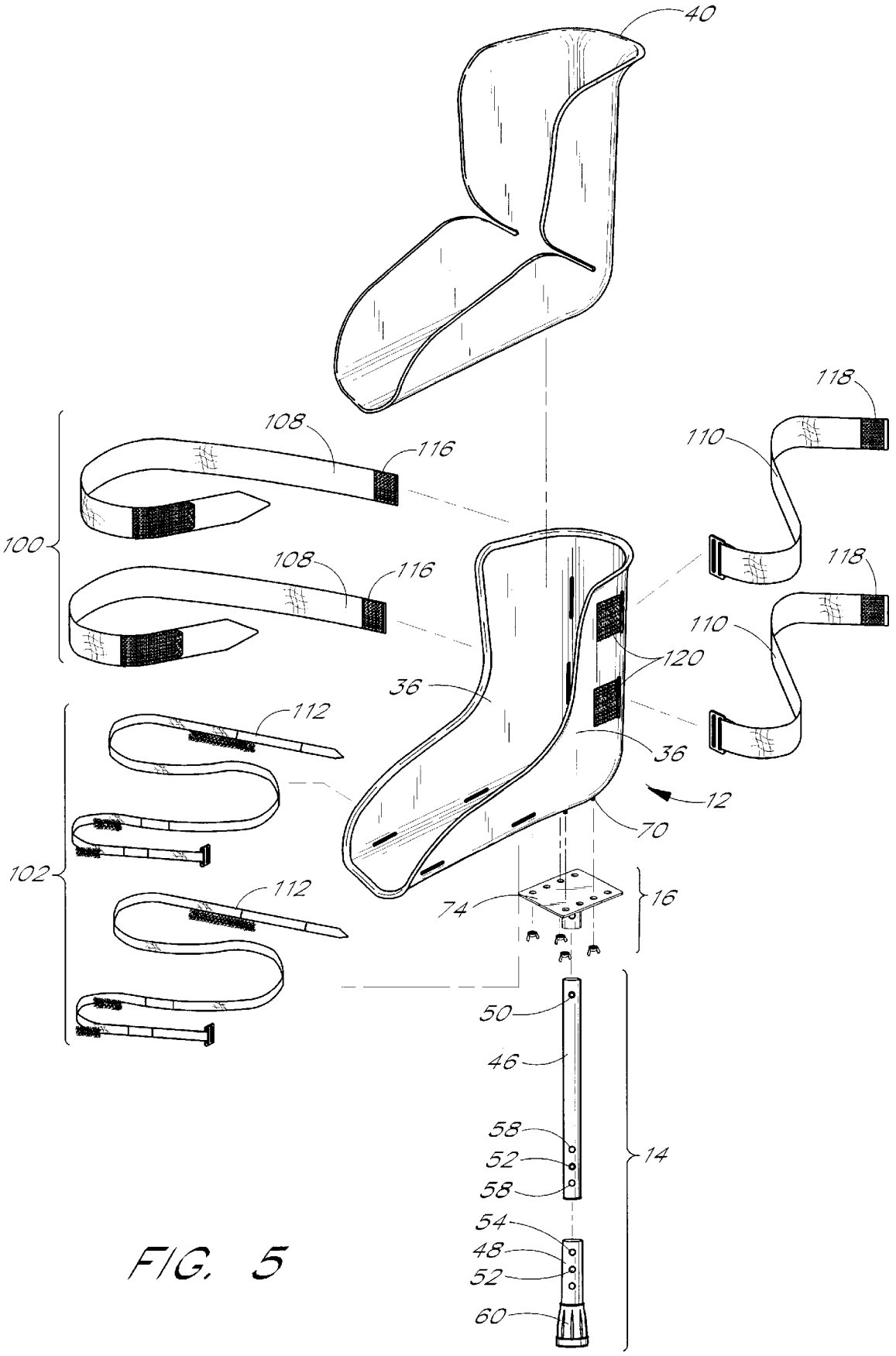
FIG. 5 illustrates an exploded perspective view of the leg support crutch of FIG. 1 from the rear-left side, showing the discrete components employed in the preferred embodiment.

The first and second portions 30, 32 are formed in a generally L-shaped configuration. The intersection 34 of the first and second portions 30, 32 is curvilinear in profile to loosely conform to the user's knee. As shown more clearly in FIG. 2, the contour of the entire leg cradle 12 closely resembles the contour of the front and sides portions of a user's thigh, knee and lower leg, but not so closely, when in use, so as to uncomfortably constrict the user's leg. An unobstructed view of the leg cradle 12 is also shown in FIG. 5.

As seen in FIG. 1, the first portion 30 is formed about a generally vertical axis "a" that intersects, in generally normal relationship, with a generally longitudinal axis "b." The second portion 32 is arranged to lie generally parallel to this longitudinal axis "b". In one embodiment, the angle between the longitudinal axes "a", "b" is acute by approximately 5° from normal so that, when the user is standing upright in the leg support crutch 10, the user's lower leg is supported by the second portion 32 in a slightly elevated manner, with the foot slightly higher than the knee. That is, the angle between the first and second portions is about 85°. This elevation of the lower leg enhances fluid draining away from the user's foot and ankle, as well as and blood circulation, during recuperation. It should be recognized that, depending upon the nature of the injury to the lower leg or foot, the incident angle between the first and second portions 30, 32 may depart from normal by varying degrees without losing the benefits of the present leg support crutch.

The length of the first portion 30 desirably equals approximately two-thirds to three-quarters of the length of the user's thigh, such that the first portion 30 extends substantially up the user's thigh. This length serves the advantage of extending the moment arm created by the first portion 30, as discussed in detail below, which serves to minimize the forces experienced by the user's thigh during use. The extended length of the first portion 30 also serves the advantage of increasing the area across which forces are spread about the user's thigh, further minimizing the forces experienced by the thigh.

The second portion 32 desirably has a length sufficient to support generally the entire length of the user's lower leg. In the illustrated embodiment, the second portion 32 extends to a point below the user's calf and just above the user's ankle to adequately support the user's foot. The outer end of the second portion 32 (i.e., the end near the user's ankle), however, does not extend so far as to cause discomfort to the user's dorsal foot and ankle. The length of the second portion is at least as long as the length of the first portion.

With reference now to FIGS. 1 and 5, a pair of integral gussets 36 extend between the first portion 30 and the second portion 32. In the illustrated embodiment, the gussets 36 are integrally formed with the sides of the first and second portions 30, 32 and are arranged to straddle the side of the user's thigh and lower leg, when worn. The gussets 36 reinforce the leg cradle 12 and transfer the weight of the second portion's outer end (which supports the user's foot and lower leg) to the first portion 30 (thereby functioning as trusses). The gussets 36 also advantageously eliminate the direct transfer of rotational forces from the weight of the user's lower leg to the strut where shear forces would otherwise be generated on the strut.

The leg cradle 12 preferably has curled edges 38 throughout, wherein the edges curl away from the user's body, as shown in FIGS. 1 through 3. This feature minimizes the risk of abrasive contact between the user and the edge of the cradle while in use. The edges also serve the added benefit of reinforcing the cradle 12 about the gussets 36 as they transfer weight from the second portion 32 to the first portion 30.

Unlike other leg support crutches that consist of multiple bands mechanically interlinked to simulate a cradle, the preferred embodiment of the leg cradle 12 is made of unitary construction and conforms to the contour of the user's thigh and leg. This construction more evenly distributes the forces borne the user's thigh during use, as discussed further below. In the preferred embodiment, the leg cradle 12 is made of molded fiberglass that permits construction of a highly contoured cradle designed to comfortably support a user's thigh and lower leg by virtually encasing the front and side portions of the thigh and lower leg. This construction also permits highly customized leg support crutches. Other similarly sturdy and moldable materials of course can also be used, such as for example plastic (e.g., PVC or ABS) and the like.

The cradle 12 also desirably includes an insert pad 40 to provide further comfort and secure fit. In the illustrated embodiment, the insert pad 40 is made of textured neoprene; however, other suitable material (e.g., nylon-wrapped foams) can also be used. As shown in FIG. 5, the insert pad 40, has a contour conforming generally to the inner surface of the cradle 12 that permits a slip fit of the insert pad 40 into the interior of the cradle 12. The edges of the insert pad 40 desirably extend beyond the curled edges 38 of the cradle 12 to further protect the user against potential abrasive contact with the rigid cradle during use.

Support Strut

FIGS. 1 and 5 also illustrate the support strut 14 which includes a rigid longitudinal portion. The rigid longitudinal portion in the illustrated embodiment comprises a telescoping support 44. The telescoping support 44 includes two concentric tubes 46, 48 in which an upper end of the smaller diameter tube 46 engages the interengaging structure 16 (which is described below). Quick-release engagement of the support strut 14 with the leg cradle is permitted by providing a quick-release fastener 50 positioned at the distal end of the smaller diameter tube 46. The quick-release fastener 50 mates with a corresponding feature in the interengaging structure 16.

The smaller and larger diameter tubes 46, 48 are movable with respect to each other in a telescoping fashion to adjust the overall length of the telescoping support 44. A second quick-release fastener 52 is used to securely fasten these tubes together once the length of the support 44 has been adjusted to a desired length.

In the illustrated embodiment, the quick-release fasteners each comprise a detent mechanism; however, other type of known quick-release fasteners can also be used. The quick-release fastener 52 at the lower end of the support 44 includes a pair of spring-biased detent balls positioned at opposite ends of the smaller diameter tube 46. The larger diameter tube 48 includes a plurality of holes 54 aligned in series to receive the second quick-release fastener 52. The second quick-release fastener 52 itself may be adjustably positioned within one of a series of holes 58 in the smaller diameter tube 46. The upper quick-release fastener 50 includes a similar structure and cooperates with a pair of holes formed in the corresponding structure of the interengaging structure, as described below.

At a lower end of the support strut 14, the larger diameter tube 48 supports a non-skid cap 60 preferably made of rubber or other suitable material to minimize slippage of the support strut 14 with the ground during use. The non-skid cap 60 may be of various configurations and preferably comprises a generally form fitting sleeve closed at the distal end to increase the area of engagement between the support strut 14 and the ground. Other configurations are contemplated, including a form fitting sleeve that includes a plurality of projecting feet each of which engage the ground in a non-skid manner.

Interconnecting Structure

Figure 4:
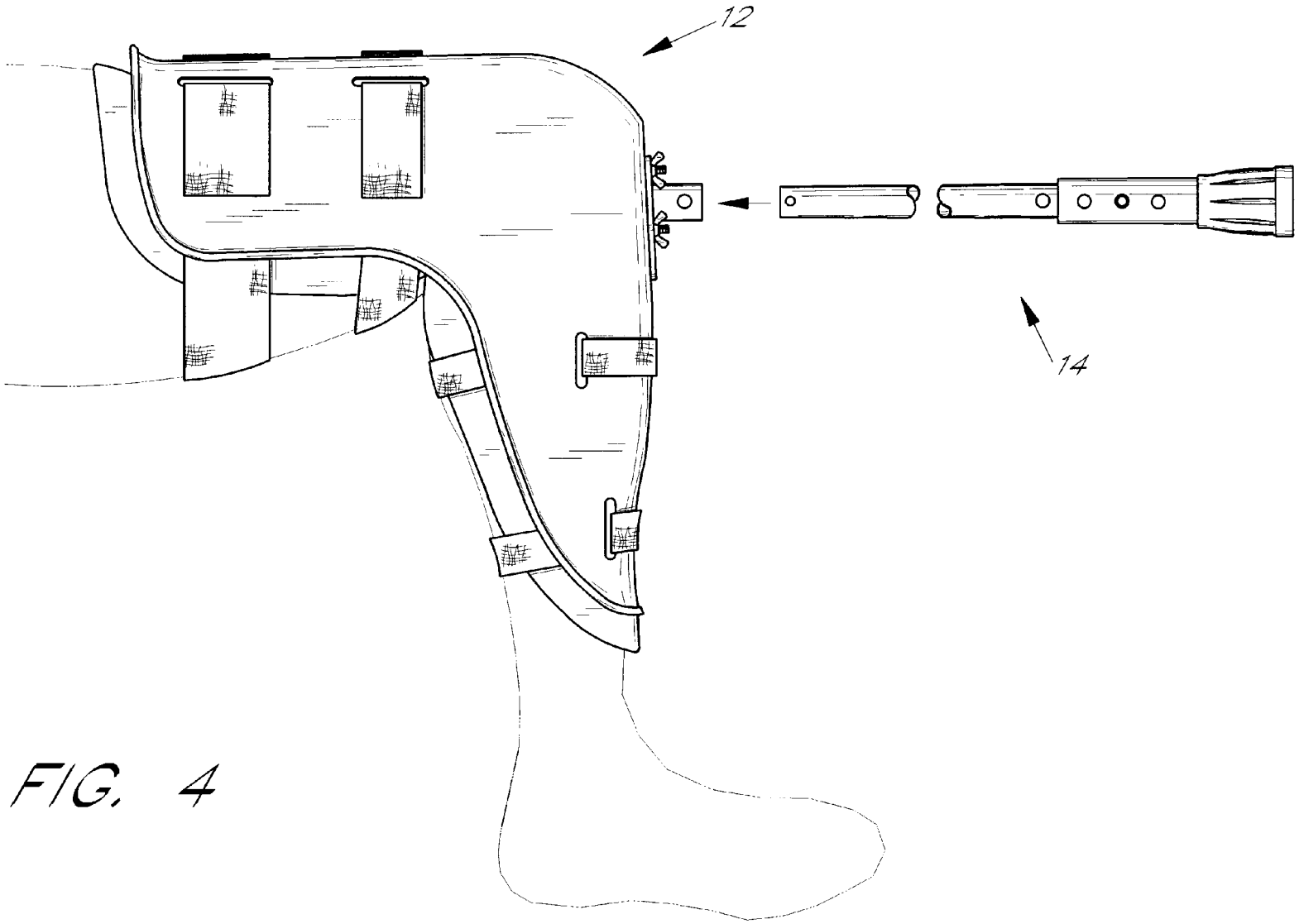
FIG. 4 illustrates a side elevational view of the leg support crutch of FIG. 1 with the user in a seated position and with a support strut disconnected.

With reference to FIGS. 1 and 4, the leg cradle 12 detachably connects to the support strut 14 via an interconnecting structure 16 positioned near the intersection between the first and second portions 30, 32. The interconnecting structure 16 permits quick detachment of the support strut 14 from the leg cradle 12 and permits the user to adjust the support strut's position relative to the vertical axis "a" of the cradle 12.

Figure 6B:
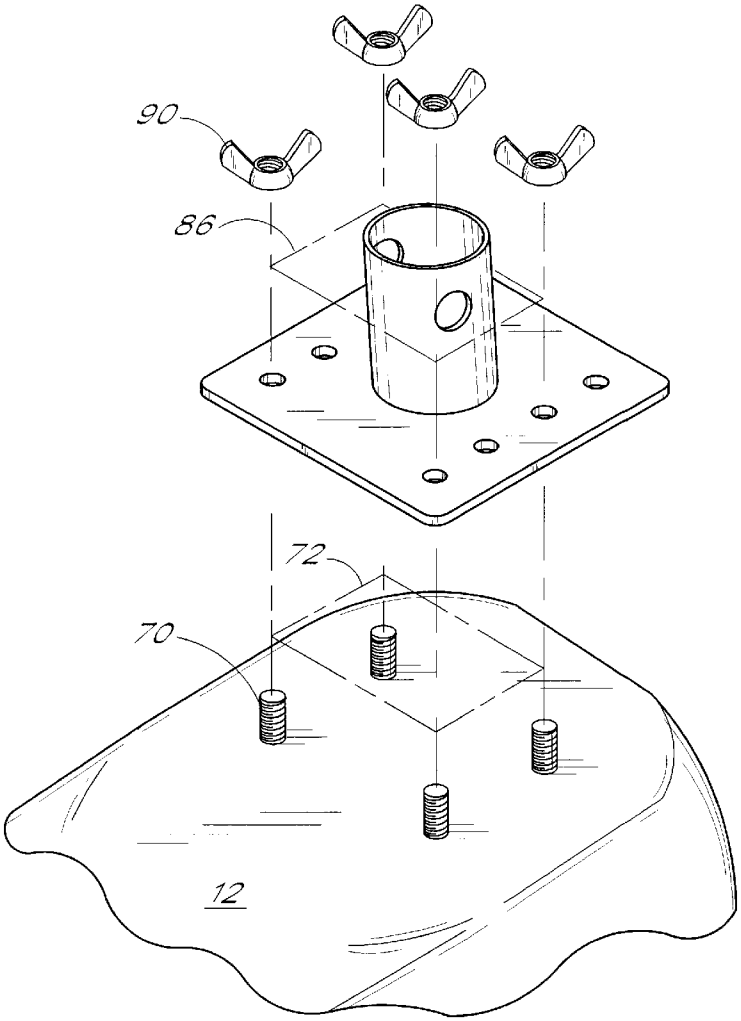
FIG. 6B illustrates an exploded perspective view of the strut, cradle and interengaging structure with the strut arranged in a second position.
Figure 6A:
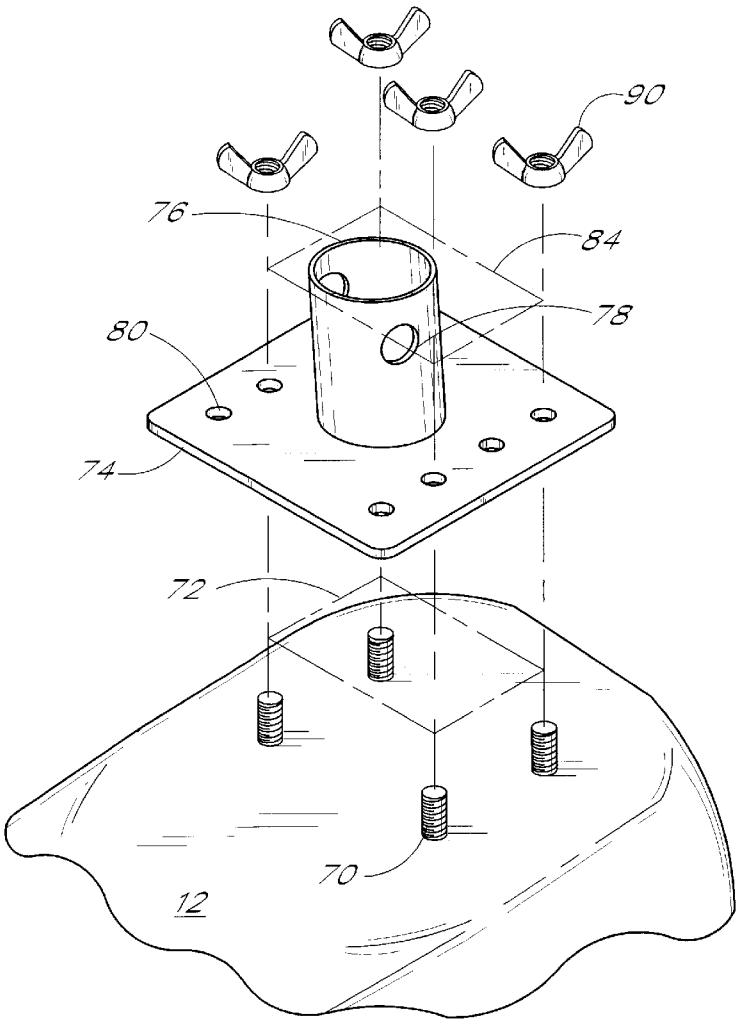
FIG. 6A illustrates an exploded perspective view of an embodiment of the interengaging structure that connects the strut to the underside of the leg cradle, with the strut arranged in a first position.

In the illustrated embodiment, best seen in FIGS. 1, 6A and 6B, the interconnecting structure comprises a plurality of studs 70 that depend from the leg cradle. These studs 70 generally extend parallel to the vertical axis "a." FIGS. 6A and 6B show the studs 70 projecting from the underside of the cradle 12. The studs 70 desirably form a geometric pattern that, in the illustrated embodiment, is a rectangle 72.

A connecting plate 74 is mechanically secured to the studs 70. As seen in FIGS. 6A and 6B, the connecting plate 74 includes a plurality of holes 80 arranged in sets of geometric patterns that correspond with the geometric pattern 72 of studs 70. There are preferably at least two sets of hole patterns 84, 86 that ensure proper mating of the plate 74 to the studs 70 and define at least two positions of the support 44 relative to the front wall of the first portion 30. To attach the connecting plate 74 to the studs 70, and, thus, secure the socket sleeve 76 to the leg cradle 12, a plurality of wing nuts 90 may be used to securely tighten the connecting plate 74 against the cradle 12.

By providing a plurality of hole patterns which mate with the plurality of studs 70, a user may adjust the support strut 14 with respect to the leg cradle 12 to more closely define a collinear relationship between the user's femur and the support strut 14, where desired. FIG. 1 shows the support strut 14 in collinear alignment with the longitudinal axis "a" of the first portion 30 and the user's femur. By doing so, the present leg support crutch 10 transfers the weight of the user's body through the femur to the support strut 14 and minimizes stress to the user's knee from the shear and torsional forces that may result from misalignment of the strut 14 and the femur. In effect, adjustability permits the user to place the strut in a location that most comfortably permits ambulatory movement.

As seen in FIG. 1, the connecting plate 74 supports a socket sleeve 76 for detachable holding the support strut 14 to the leg cradle 12. The socket sleeve 76 includes a hole 78 therethrough that receives the detent balls of the quick-release fastener 50 to releasably lock the strut 14 to the socket sleeve 76.

FIG. 1 also shows the support strut 14 securely fastened to the cradle 12. The connecting socket 76 slidably receives the upper end of the smaller diameter tube 46 which is locked in a seated position within the connecting socket 68 by the quick-release mechanical fastener 50. The quick-release feature is advantageous in that a user may quickly detach the support strut 14 from the leg cradle 12 when the user decides to sit down, as shown in FIG. 4.

Fasteners

FIGS. 1 through 3 best illustrate the plurality of fasteners 20, 22, 24, 26 used to secure the user's leg within the cradle. The fasteners 20, 22, 24, 26 are supported on the leg cradle 12 in a manner that permits effective securement to the user during use. In the illustrated embodiment, there are four fasteners that are include straps 100, 102 made of nylon, each threaded through a plurality of slots 104 provided in the leg cradle 12. The straps 100 of the upper two fasteners 20, 24 are preferably wider than the straps 102 of the lower two fasteners 24, 26. The difference in width reflects the difference in both the magnitude of the forces borne by the thigh as compared to the lower leg, as well as the size of the thigh as compared to the size of the lower leg. FIG. 5 illustrates the position of the slots 104 and the relative size of the preferred straps 100, 102 more clearly.

The positions of the fasteners 20–26 in the present invention and the number thereof are important in achieving the improved level of comfort and effectiveness described herein. In the preferred embodiment, there are two fasteners 20, 22 associated with the first portion 30 of the cradle 12 and two fasteners 24, 26 associated with the second portion 32 of the cradle; however, more fasteners can be used. Providing multiple fasteners associated with each cradle portion more effectively distributes the load carried by the user's leg positioned within the cradle and eliminates potential rocking about a single fastener point of contact when only one fastener is used.

The first fastener 20 is preferably placed at an upper end 106 of the first portion 30 of the cradle 12 away from the intersection between the first and second portions 30, 32. During use, while the user is in stride, the interaction between the strut 14 and the ground as the user walks have a tendency pull the first portion upper end away from the user's thigh, thereby causing the cradle to rotate about the user's knee. (This rotational axis is normal to the intersection of the longitudinal axes "a", "b"). Additional rotational forces are also experienced about generally the same axis due to the downward force of the user's leg weight caused by the lower leg being cantilevered beyond the second portion 32 of the cradle 12. While the rigid construction of the leg cradle 12 and the support strut 14 (as implemented by the interengaging structure 16) will effectively resist these rotational forces, the user's thigh must necessarily bear some of that resistance. The first portion 30 is, thus, a moment arm about the axis of rotation through the user's knee. The longer the moment arm, the less force will be transmitted at the first fastener 20 due in acting upon and reacting to the rotational forces. In other words, on the down stroke of the present leg support crutch, the ground (and the weight of the lower leg) will exert a rotational force that tends to push the first portion 30 of the cradle 12 against the user's thigh. The longer the first portion 30, the greater the area of engagement between the first portion 30 and the user's thigh, thus distributing those forces to a greater extend and minimizing the forces experienced by the thigh.

On the upstroke, however, the user's forward momentum will translate into forces that tend to pull the first portion 30 away from the user's thigh. By placing the first fastener 20 as close to the distal end 106 of the first portion as feasible and, thus, maximizing the moment arm as measured by the location of the first fastener 20, the force transmitted to the thigh when the present leg support crutch is in use is minimized. Thus, the present invention minimizes the force exerted on or by the thigh by extending the moment arm of the first portion 30 as far as possible and selectively placing the first fastener 20 very close to the distal end of the first portion 30.

The second fastener 22 is preferably placed proximal the intersection of the first and second portions 30, 32 but sufficiently spaced therefrom to avoid constriction of the popliteal fossa and popliteal artery contained therein. Prolonged constriction of the popliteal artery may result in irreparable damage and may diminish recuperation efforts, besides causing discomfort and pain. The present leg support crutch avoids such constriction by selectively placing the second fastener 22 above the intersection of the first and second portions 30, 32.

The third and fourth fasteners 24, 26 are provided in the second portion 32 of the cradle 12 and are positioned such that the third fastener 24 is located about the longitudinal mid-point of the user's calf and the fourth fastener 26 is located at the narrowing portion of the user's calf and near the user's ankle, that is generally at the second portion's outer end. Although relatively minimal, some forces will be experienced by the lower leg on the upstroke of the user's gait. Thus, it is preferably that the third fastener 24 be positioned at the mid-point of the calf where the lower leg may sustain the most force. The fourth fastener 26 positioned at the bottom of the calf and close to the ankle serves to stabilize the lower leg and maintain the user's foot in a comfortably restrained position to enhance recuperation.

With reference to FIG. 5, the first and second fasteners 20, 22 each preferably include two discrete strap segments, a first strap segment 108 and a second strap segment 110. At a first end of each first strap segment 108, a fastening mechanism 114 is provided for detachably affixing the strap segment 108 to a corresponding fastening mechanism 118 on the exterior of the leg cradle 12. Preferably the detachable fastening mechanism is a hook and loop fastener, such as Velcro®, with the hook portion (114) provided on the first strap segment 108 and the loop portion (118) provided on the exterior of the leg cradle 12. Similarly, at a first end of each second strap segment 110, a similar detachable fastening mechanism 116, such as a hook fastener, is also provided to mate with a corresponding loop fastener (not shown) provided on the exterior of the leg cradle 12 on the opposite side of the cradle 12 from the loop portion 118. The first and second strap segments 108, 110 may then be buckled together behind the user's thigh to adjust the straps as tightly as desired. It should be noted that any arrangement of one or multiple straps may be employed to effectively fasten the first portion 30 to the user's thigh.

In the illustrated embodiment, the third and fourth fasteners include a single strap segment 112, each of which slidably moves within the slots 104 within the second portion 32 of the leg cradle. If desired, the third and fourth straps may also include hook fasteners to engage loop fasteners affixed to the underside of the lower portion to prevent undesired sliding of the straps 112. The straps may be buckled around the user's lower leg to comfortably restrain the lower leg within the leg cradle 12.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A leg support crutch that permits ambulatory movement of a user recuperating from a lower leg or foot injury by supporting the user's upper body and injured lower leg in a manner that transfers the user's body weight through the users thigh and knee directly to said leg support crutch so as to bypass weight transfer through the user's injured lower leg or foot, said leg support crutch comprising:

a leg cradle of unitary construction having a generally L-shaped configuration defined by a first portion having a curved contour and a second portion positioned generally normal to said first portion and integral therewith, said second portion having a curved contour, said first and second portions defining generally vertical and longitudinal axes, respectively, that are generally normal to each other, a length of said second portion along the longitudinal axis being generally as long as a length of said first portion along the vertical axis for supporting user's lower leg and thigh, respectively, said cradle further defined by integral gussets reinforceably joining opposite sides of said first and second portions;

a support strut connected to the cradle proximal to the intersection of said first and second portions so as to be generally parallel with the generally vertical axis of said first portion when said support strut is attached to said cradle;

an interconnecting structure detachably connecting the support strut to the leg cradle; and a plurality of fasteners positioned on each of said first and second portions of said leg cradle to permit the attachment of said cradle to the user's thigh and lower leg.

2. The leg support crutch of claim 1, wherein the interengaging structure between the strut and cradle is adjustable to establish a plurality of positions for the strut on the cradle, whereby the strut can be positioned generally collinear with the user's femur to enhance the transfer of the user's body weight to said strut while minimizing stress on the user's knee.

3. The leg support crutch as in claim 2, wherein said interconnecting structure comprises a plurality of studs, a connecting plate and a socket sleeve affixed to the connecting plate, said connecting plate and studs being configured to adjustably connect said support strut to said leg cradle at a plurality of locations.

4. The leg support crutch of claim 3, wherein said studs are arranged in a geometric pattern and are positioned proximal the intersection of the first and second portions so as to project outwardly away from the leg cradle in a direction generally parallel to the longitudinal axis extending through said first portion, and wherein said connecting plate has a plurality of hole patterns each of which pattern corresponds to the pattern of studs projecting from said cradle to permit releasable and adjustable mechanical connection between said strut and said cradle.

5. The leg support crutch of claim 1, wherein said plurality of fasteners includes a first fastener positioned at an end of the first portion of the cradle distal from the second portion.

6. The leg support crutch of claim 5, wherein said plurality of fasteners includes a second fastener positioned on the first portion proximal to the second portion but sufficiently spaced therefrom to permit attachment of the cradle to a user's leg above the popliteal fossa so as to minimize constriction of the popliteal artery when in use.

7. The leg support crutch of claim 6, wherein said plurality of straps further includes third and fourth fasteners positioned on the second portion to permit attachment of said second portion to the lower leg of the user, the third fastener being positioned proximal to the middle of the user's calf muscle when in use and the fourth fastener being positioned proximal to the bottom of the user's calf and the user's ankle.

8. The leg support crutch of claim 1 additionally comprising an cushion insert of resilient material having a contour generally the same as the contour of the interior of the leg cradle.

9. The leg support crutch of claim 1 additionally comprising a non-skid cap positioned on an end of the support strut distal from the leg cradle.

10. A leg support crutch that permits ambulatory movement of a user recuperating from a lower leg or foot injury, said leg support crutch comprising:

a leg cradle comprising fist and second portions arranged in a generally L-shaped configuration, the first portion having a length that is generally as long as a length of the second portion, said first portion configured to bear against the user's thigh and the second portion configured to support the user's lower leg, said leg cradle including a first gusset connecting a fist side of the first and second portions and a second gusset connecting a second side of the first and second portions such the gussets straddle a portion of the user's thigh and lower leg;

a support strut detachably connected to the cradle so as to be generally parallel with a generally vertical axis of the first portion of said cradle;

an interengaging structure detachably connecting the support strut to the leg cradle, and a plurality of adjustable fasteners positioned on each of the first and second portions of the leg cradle to permit the attachment of the cradle to the user's thigh and lower leg.

11. The leg support crutch of claim 10, wherein the interengaging structure comprises a plurality of studs, a connecting plate and a socket sleeve affixed to the connecting plate, said socket sleeve configured to detachably accept one end of the support strut.

12. The leg support crutch of claim 11, wherein the connecting plate and studs are configured to detachably connect the support strut to the leg cradle at a plurality of locations.

13. The leg support crutch of claim 10, wherein the first portion, second portion and gussets are constructed in a unitary fashion.

14. A leg support crutch that permits ambulatory movement of a user recuperating from a lower leg or foot injury, said leg support crutch comprising:

a leg cradle of unitary construction having a generally L-shaped configuration and comprising a first portion and a second portion that extend along a vertical axis and a longitudinal axis, respectively, a length of said second portion being generally as long as a length of said first portion for supporting the user's lower leg and thigh, respectively;

a support strut detachably connected to the cradle so as to be generally parallel to said vertical axis extending through the first portion of the leg cradle;

an interengaging structure detachably connecting the support strut to the leg cradle, said interengaging structure permitting attachment of said support strut to said leg cradle at a plurality of locations on the cradle; and a plurality of adjustable fasteners positioned on the cradle to permit the attachment of the cradle to the user's thigh and lower leg.

15. The leg support crutch of claim 14, wherein the cradle additionally comprises at least one gusset arranged along at least a side portion of opposing ends of said first and second portions for connecting the first portion of said cradle to the second portion of said cradle.

16. A leg support crutch that permits ambulatory movement of a user recuperating from a lower leg or foot injury, said leg support crutch comprising:

a leg cradle comprising first and second portions arranged in a generally L-shaped configuration, the first portion having a length that is generally as long as a length of the second portion, said first portion configured to bear against the user's thigh and the second portion configured to support the user's lower leg, said leg cradle including a first gusset connecting a first side of the first and second portions and a second gusset connecting a second side of the first and second portions such that the gussets straddle a portion of the user's thigh and lower leg;

a support strut detachably connected to the cradle so as to be generally parallel with a generally vertical axis of the first portion of said cradle; and a plurality of adjustable fasteners positioned on each of the first and second portions of the leg cradle to permit the attachment of the cradle to the user's thigh and lower leg.

17. A leg support crutch of claim 16 further comprising means for attaching the support strut to the cradle in a plurality of locations, whereby the strut can be located generally collinear with the user's femur.

18. A leg support crutch that permits ambulatory movement of a user recuperating from a lower leg or foot injury, said leg support crutch comprising:

a leg cradle comprising first and second portions arranged in a generally L-shaped configuration along a longitudinal axis and a generally vertical axis, said second portion having a length so dimensioned as to extend substantially along said lower leg to a point near said user's ankle;

a support strut connected to the cradle; and an interengaging structure having an adjustable coupling which detachably connects the support strut to an underside of the leg cradle, said interengaging structure configured to permit attachment of said support strut to said leg cradle at a plurality of locations on the cradle.

19. A leg support crutch of claim 18 additionally comprising means for transferring the weight of a user's lower leg from the second portion of the cradle to the first portion of the cradle.

20. The leg support crutch of claim 18, wherein said transferring means is constructed unitary with the first and second portions of the cradle.

21. A leg support crutch that permits ambulatory movement of a user recuperating from a lower leg or foot injury, said leg support crutch comprising:

a leg cradle of unitary construction having a generally L-shaped configuration, said cradle comprising a first portion arranged along a longitudinal axis and a second portion arranged along a vertical axis for supporting a load, a length of said second portion being generally as long as a length of said first portion for supporting the user's lower leg and thigh, respectively;

means for connecting the first and second portions of said cradle so as to permit the transfer of weight from said second portion to said first portion when the leg support crutch is in use;

a support strut detachably connected to the cradle to carry the load; and means for detachable connecting the support strut to the leg cradle, said means being positioned between the support strut and the leg cradle and permitting attachment of said support strut to said leg cradle at a plurality of locations on the cradle;

the leg cradle including means for attaching the cradle to the user.

22. A method of minimizing the stress on the knee and thigh of a person recuperating from a lower leg or foot injury while the person is ambulatory, said method comprising the acts of:

providing a cradle including an upper portion and a lower portion arranged in a generally L-shaped configuration so as to conform to and extend generally along a portion of a user's thigh, knee and lower leg, the cradle further including an adjustable coupling for connecting a rigid support strut to the cradle;

enclosing a portion of the user's thigh and lower leg in the cradle with the upper portion of said cradle extending substantially along the user's thigh;

supporting the user's knee and a substantial portion of the user's lower leg with the cradle lower portion from a point next to the user's knee to a point near the user's ankle;

using the adjustable coupling to adjustably position the rigid support strut to the cradle lower portion proximal to where the user's knee is held within the cradle so that the strut is arranged in generally alignment with the user's femur to enhance the transfer of the user's body weight to said strut while minimizing stress on the user's knee; and attaching said strut to the cradle in the aligned position.

23. A method as in claim 22, wherein attaching the strut to the cradle involves interengaging cooperating elements of a releasably coupling mechanism which operates between the strut and the cradle.

* * * * *

UNITED STATES PATENT AND TRADEMARK OFFICE

CERTIFICATE OF CORRECTION

PATENT NO. : 5,941,263
DATED : August 24, 1999
INVENTOR(S) : Steven F. Bierman

It is certified that error appears in the above-identified patent and that said Letters Patent is hereby corrected as shown below:

Column 2,
Line 9, please delete "or section" and insert -- or second --

Column 10,
Line 18, please delete "fist and" and insert -- first and --
Line 24, please delete "a fist" and insert -- a first --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*